United States Patent [19]

Ritter

[11] Patent Number: 4,686,693

[45] Date of Patent: Aug. 11, 1987

[54] REMOTELY CONTROLLED SOUND MASK

[75] Inventor: David W. Ritter, Holmes, Pa.

[73] Assignee: Sound Mist, Inc., Newtown Square, Pa.

[21] Appl. No.: 735,570

[22] Filed: May 17, 1985

[51] Int. Cl.[4] ..... H04R 3/00

[52] U.S. Cl. ..... 381/73.1

[58] Field of Search ..... 381/73, 107, 102; 179/1.5 M

[56] References Cited

U.S. PATENT DOCUMENTS

| | | | |
|---|---|---|---|
| 3,213,851 | 10/1965 | Currea | 381/73 |
| 3,406,344 | 10/1968 | Hopper | 325/50 |
| 3,701,946 | 10/1972 | Anderson | 325/64 |
| 3,814,856 | 6/1974 | Dugan | 179/1 AT |
| 3,980,827 | 9/1976 | Sepmeyer et al. | 381/73 |
| 4,024,535 | 5/1977 | Goldstein | 340/384 E |
| 4,054,751 | 10/1977 | Calder et al. | 179/1.5 M |
| 4,059,726 | 11/1977 | Watters et al. | 179/1.5 M |
| 4,080,602 | 3/1978 | Hattori | 343/225 |
| 4,082,918 | 4/1978 | Chang et al. | 381/73 |
| 4,185,167 | 1/1980 | Cunningham | 381/73 |
| 4,189,713 | 2/1980 | Duffy | 340/168 R |
| 4,228,402 | 10/1980 | Plummer | 381/102 |
| 4,280,019 | 7/1981 | Propst et al. | 381/73 |
| 4,413,261 | 11/1983 | Greenberg | 340/825.72 |
| 4,423,289 | 12/1983 | Swinbanks | 381/71 |
| 4,438,526 | 3/1984 | Thomalla | 381/73 |
| 4,473,906 | 9/1984 | Warnaka et al. | 381/71 |
| 4,476,572 | 10/1984 | Horrall et al. | 381/73 |
| 4,550,400 | 10/1985 | Henderson, Jr. | 381/107 |

*Primary Examiner*—Gene Z. Rubinson
*Assistant Examiner*—L. C. Schroeder
*Attorney, Agent, or Firm*—Steele, Gould & Fried

[57] ABSTRACT

A sound masking apparatus especially useful for setting background noise levels in discrete zones includes a signal source, power amplifier, programmable attenuator and remote control. The remote control is a short range radio transmitter that sends a series of pulses that are decoded to control the attenuator. The attenuator selects among discrete possible volume levels using serially-connected analog multiplexers, the multiplexer-selected lines connecting the signal to a desired part of a resistor network defining voltage dividers. The short range radio control makes a single remote controller operable to control volume levels in any zone of a multiple zone installation without direct access to the signal source, whereby the user can change volume levels in small increments to accomodate changing conditions or preferences and to slowly bring sound masking units to full volume levels.

22 Claims, 7 Drawing Figures

REMOTELY CONTROLLED SOUND MASK

BACKGROUND OF THE INVENTION

1. Field of the Invention

This invention relates to the field of sound masking apparatus for producing an incoherent white or pink noise signal, and more particularly to an installation having a plurality of separate masking zones in which independent sound sources are responsive to a single remote control.

2. Prior Art

The general proposition of acoustic masking, namely the production of an incoherent audible-frequency sound for privacy or as a means to cover or mask unwanted noise has been known for some time. Recently, it has been suggested that in an open office space such as an area divided into workspaces by relatively low level partitions, a plurality of separate masking sources could be employed to provide an overall masking effect responsive to differences in the acoustic properties of the individual zones within the whole. Reference can be made, for example, to U.S. Pat. Nos. 4,438,526—Thomalla; 4,476,572—Horrall et al; 4,059,726—Watters et al; 4,054,751—Calder et al; and, 4,024,535—Goldstein. The disclosures of these patents are incorporated herein by reference.

Although the aforesaid patent to Horrall et al advocates mounting the individual units adjacent the floor in the office partitions, it is more frequently the case that the sound production elements are mounted in hollow ceilings of office spaces. One part of installation of such prior art devices is to adjust the individual units to match both the acoustic properties of the space to be masked, and also to minimize differences between adjacent zones such that masking flows smoothly from zone to zone. The patent to Thomalla teaches an active closed loop control which is operative to produce a masking signal reflecting the noise already present in the masked zone. Such a system operates by bringing the volume at a plurality of frequency ranges up to a chosen background level. Emission of noise in a given frequency range by the masking device is corresondingly reduced when a source such as a person emits a sound in that range in the controlled zone. This is an effective means to facilitate matching conditions between neighboring zones, but is expensive and complicated. Furthermore, there is no practical way of making incremental changes in the volume of the background masking noise over time, as might be required to slowly acclimate employees to a masking system, or to expand a masking system into new zones without disruption.

Volume controls are normally mounted directly on (or in) the sound generator units. In the system of Horrall et al, the sound generators are accessibly mounted. It would be possible in ceiling-mounted devices to locate a volume control means and/or an equalizer for adjusting volumes in individual frequency ranges at a position which is accessible for adjustment as needed. For example, the location could be a central control area or the area around the masking noise generator itself. Neither of these possibilities is entirely adequate. If a central control area is used for adjusting volumes, some means must be had to detect the noise present in the zone to determine the changes to be made. If the control is mounted for easy access in the area of the noise source, uniformity will be lost as changes are made in volume emissions with regard only to local effects. Furthermore, individual volume adjustments for the zones are only necessary occasionally, and including a complete volume-control device and permanent wiring for each zone is unnecessarily expensive.

According to the invention, limited access for controlling a noise source in the immediate vicinity of a mobile controller is provided by means of short range radio control. The radio controller is provided with a direct readout of the noise level detected in the zone, and may have means for inserting a signal in the background noise emitted from sources responding to the controller signal such that the user can correctly determine the noise level as a function of displacement from the noise source.

Radio remote controls are known in connection with various devices. A well-known example is the radio remote control transmitter used to control the movements of a toy vehicle such as model car or airplane. An example of such a system is shown in U.S. Pat. No. 4,080,602—Hattori et al. Different combinations of signals transmitted on a channel are decoded into vehicle movements in various directions. Typically, the controlled device is adapted such that control signals cause a momentary deflection in a controlled element such as a steering linkage. Alternatively, the presence of the signal causes operation of a motor or the like to increase or decrease the present deflection of the controlled element.

According to the invention, a volume control signal in the form of pulses is applied to ring-counter having a predetermined number of discrete intervals corresponding to volume levels. The remote control can broadcast a number of pulses equal to the capacity of the counter, resulting in no change due to a complete cycling of the ring counter. Broadcasting the full capacity count less some number of pulses will cause a decrease in volume deflection by that number of pulses. Similarly, broadcasting only a few pulses will bump the ring counter up by the corresponding amount and increase volume by that number of steps. The steps are decoded to actually select volume levels using an analog multiplexer responsive to pulse count. The use of a pulse train allows the system to take advantage of start and stop indicators, and other means of reducing problems with spurious pulses.

Selecting a volume level by adjustment of a voltage divider is known. The conventional volume control adjustment is based upon a potentiometer connected such that the wiper of the potentiometer, which selects any point of connection along an internal resistor selects the extent of voltage division. The aforesaid patent to Goldstein teaches a resistor ladder formed of a plurality of serially-connected resistors, the individual connections between resistors being accessible for connection of signals of predetermined frequency range and decibel levels. The present invention has taken a different approach to attenuation, using a plurality of remotely-controlled analog multiplexers to provide a no-moving-parts means of selecting among attentuation levels. The analog multiplexers are addressable to connect a first line to any of a plurality of second lines, as indicated by a digital address input presented on address bits. According to the invention, the binary count output bits of the attenuator's ring counter are connected to the digital address input bits of analog multiplexers, for volume step adjustments.

The device of the invention provides the optimum adjustment of individual zone masking devices. Fine volume changes are easily made to meet the individual acoustic demands of the masking zone and the personal preferences of persons therein. The ease of adjustment makes it quite easy to slowly change the masking signal volume as needed, whereby the occupants of the masked area are not distracted by a sudden increase or decrease in background masking noise. Nevertheless, according to the invention, the background masking noise can also be made to drop out during paging signals. The volume can be easily adjusted automatically or under manual remote control, for temporary or permanent changes without additional wiring or direct access to the sound source.

The device of the invention is effective as noted, is low in cost, and is extremely reliable. The invention provides full versatility and maximum convenience.

SUMMARY OF THE INVENTION

It is an object of the invention to provide a multi-zone sound masking device in which the masking signal emitted from individual zone units is adjustable by means of a controller which is mobile and may be brought to the controlled zone only occassionally, to set the masking signal, the masking signal then thereafter being indefinitely maintained as set.

It is another object of the invention to provide volume control of a single sound-masking device by means of a stepwise adjustable attenuator responsive to a pulse train from a controller.

It is also an object of the invention to provide a noise-insensitive control signal for a sound masking attenuator.

It is still another objection of the invention to allow the masking noise of newly-installed sound masking systems to be marginally adjusted, for example, slowly brought up to full level over a period of time, without physically accessing the individual sound-emitting elements after installation thereof.

It is still another objection of the invention to provide a low cost and reliable sound masking device optimally responsive to changes as required over time and among individual zones, to reflect personal preference, and to accomodate acoustic properties of zones and articles placed in the zones.

These and other objects are accomplished by a sound masking apparatus especially useful for setting background noise levels in discrete zones including a signal source, power amplifier, programmable attenuator and remote control. The remote control is a short range radio transmitter that sends a series of pulses that are decoded to control the attenuator. The attenuator selects among discrete possible volume levels using serially-connected analog multiplexers, the multiplexer-selected lines connecting the signal to a desired part of a resistor network defining voltage dividers. The short range radio control makes a signal remote controller operable to control volume levels in any zone of a multiple zone installation without direct access to the signal source, whereby the use can change volume levels in small increments to accomodate changing conditions or preferences and to slowly bring sound masking units to full volume levels.

BRIEF DESCRIPTION OF THE DRAWINGS

There are shown in the drawings the embodiments that are presently preferred. It should be understood, however, that the invention is not limited to the precise arrangements and instrumentalities shown in the drawings, wherein.

DETAILED DESCRIPTION OF THE PREFERRED EMBODIMENTS

Figure 1:
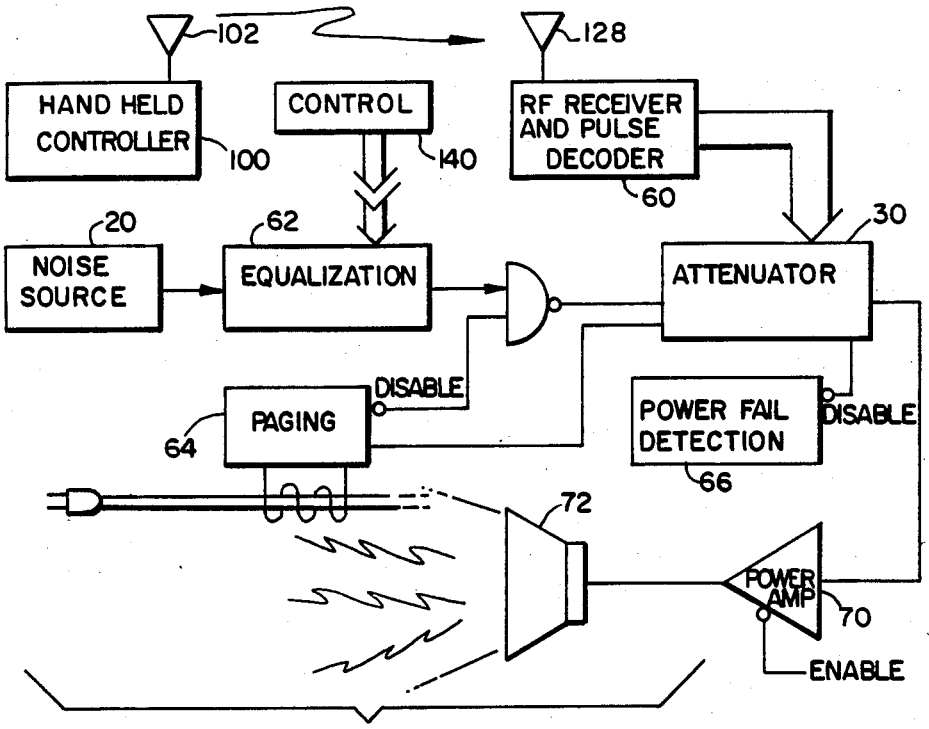
FIG. 1 is a block diagram of the sound masking apparatus according to the invention.

The basic device of the invention, as shown in FIG. 1, includes a hand-held controller 100 operable by transmission of a radio signal to receiver 60 to control the emission of a masking noise, and optionally, a paging system. A programmable attenuator 30 is located in the signal path between a noise source 20 and an audio transducer (i.e., loudspeker) 72. The programmable unit 30 adjusts the overall amplification, together with amp 70, of an audio-frequency incoherent electrical signal produced by source 20 and emitted as acoustic vibration by speaker 72. A programmable attenuator is preferred, with am amplifier 70 of preset gain. It will be appreciated that a programmable-gain amplifier could be used as well. The signal from the controller 100 can optionally control an equilization device 62, preferably placed upstream in the signal path from the attenuator 30. Suitable power failure detection 66 is provided to prevent spurious change in the volume level should power be lost and/or to maintain the preset attenuation level during power failures. A power amplifier 70 proportionally amplifies the output of attenuator 30 to provide volume control.

Noise source 20 may be a source of "white" or "pink" noise, or may be provided with other frequency characteristics as required. It is presently preferred that the noise source produce so-called "pink" noise, that is, having an equal power across all spans in its frequency range as measured in octaves or portions of octaves, rather then so-called "white" noise which has an equal power across frequency spans as measured in Hertz.

Figure 2:
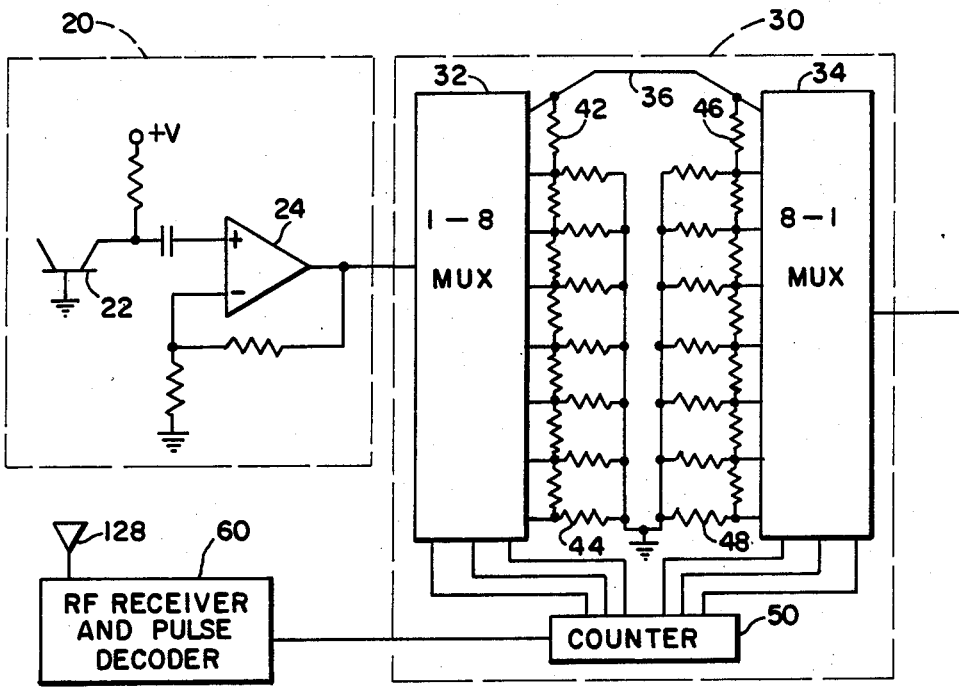
FIG. 2 is a schematic diagram showing the signal source and attenuator sections of the invention in more detail.

As shown in FIG. 2, the equalization and paging elements can be bypassed and noise source 20 operated to supply a signal directly to attenuator 30. Noise source 20 may be a digital random code generator and filter, or may be an analog noise source as shown. In FIG. 2, noise source 20 produces an analog noise signal due to the non-periodic nature of breakdown of a base-emitter junction on transistor 22. Suitable biasing is provided and the signal is amplified by means of op amp 24 for presentation at predetermined level to attenuator 30. Attenuator 30 is a programmable digital attenuator wherein the particular volume level is set by means of remote control. A hand held controller (see FIG. 1) transmitting by means of antenna 102 sends a low frequency pulse-coded signal across the open air to RF receiver and pulse decoder 60, which signal is received by antenna 128, tuned to the desired signal. Means are provided to reduce sensitivity to spurious pulses, including stop and start pulses and maximum time windowing, but essentially, the RF receiver and pulse decoder receive and output a train of pulses to ring counter 50, which counts and sets the attenuation level by means of analog multiplexer networks 32, 34.

Multiplexers 32, 34 are based upon CMOS analog multiplexer chips having three address lines operative to effect a solid state connection of one input line to any one of eight output lines, or in the alternative, to connect any one of eight input lines to one output line. Analog multiplexers of this general type are known for various purposes, and are also sometimes operated as digital multiplexers.

Multiplexers 32, 34 may be operated in either the 1:8 or 8:1 direction with similar results. In FIG. 2, the multiplexers are shown back-to-back in reversed directions for purposes of illustration. Multiplexer 32, which may be termed the "expander" multiplexer can connect the output of amplifier 24 directly to signal line 36, or to any of the seven other selectable lines which are connected to signal line 36 by voltage dividers including serial resistors 42 and parallel resistors 44. The signal is attenuated by the voltage division of the connection through multiplexer 32 and its output network including resistors 42, 44. The amount of attenuation is determined by the value and number of serial resistors 42 which are placed in the connection between the selected output line and signal line 36.

Multiplexer 34 operates in an analogous way in reverse order. An input to multiplexer 34 through signal line 36 appears at its full voltage only at one of the selectable lines, and at the remaining seven selectable lines is stepped down by one or more series-connected resistors 46, which together with parallel resistors 48 provide a series of voltage dividers having values depending on the connection points. The output of counter 50, which is an eight bit binary counter, is applied to the address bit of multiplexers 32, 34 such that the increase of the count on the output of counter 50 corresponds to an increase (or decrease) in attenuation level based on the change of voltage division selected by multiplexers 32, 34.

Controller 100 and its radio communication with RF receiver and pulse decoder 60 and short range, low frequency and pulse-modulated. Controller 100 is preferably the one and only controller provided to control any of a plurality fo attenuators in the separately-packaged independent noise emission devices located at various spaced places throughout a working environment such as a open office space. The packaged individual units for emission of noise comprise a noise source 20, attenuator 30, power amplifier 70 and loud speaker 72, the volume being controlled by RF receiver 60, also packaged with the unit. Therefore, limiting the operation of controller 100 to a short range allows the office manager or the like to physically move through the zones of masking and to control the operation of the individual units to achieve both custom operation as reqiured for individual and to account for any acoustic sinks such as rugs or furniture in the zone, and also to achieve a smooth transition between zones.

Figure 3:
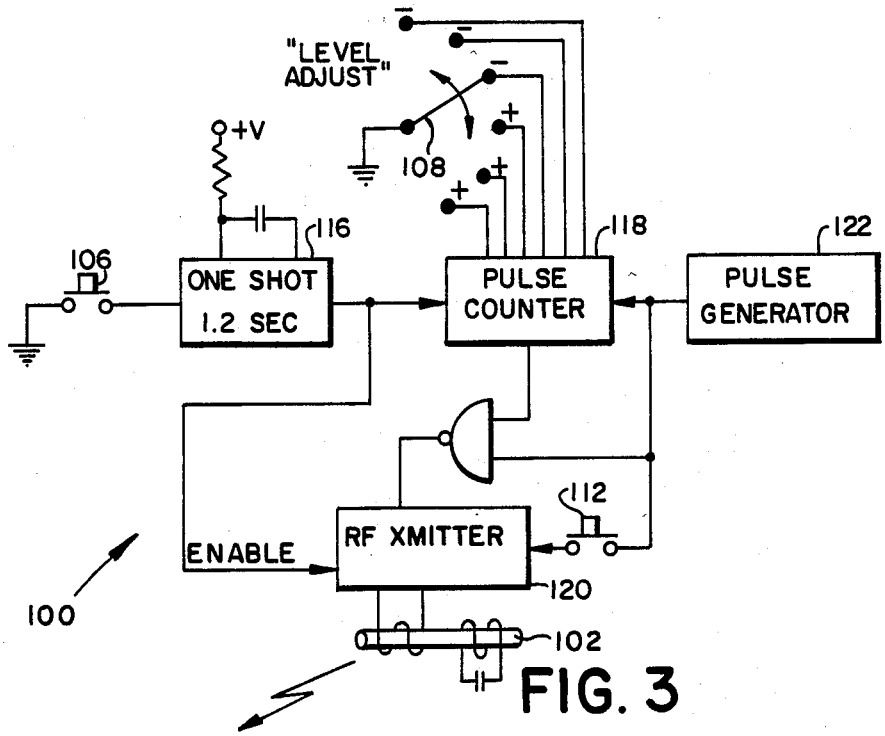
FIG. 3 is a block diagram showing the operation of the remote control transmitter.

The internal components of transmitter 100 are illustrated in FIG. 3, in block-diagram form. Transmitter 100 is preferably a battery-powered device having rechargeable batteries. The physical unit is pictured in FIG. 6, and its operation in FIG. 3. A user desiring to adjust the level of an attenuator within range sets the deflection desired on rotary switch 108, marked to show increase or decrease in volume output. Switch 108 is operative to set a desired-count a pulse counter 118, which may comprise a binary counter, comparator and suitable gating to indicate that the desired count has been reached. Pulse generator 122, which continuously outputs pulses, has its output gated to an RF transmitter during a time window determined by one shot 116 and the time taken to count to the desired pulse count on counter 118. Transmitter 120 may be enabled during a time window in response to an "initiate" closure. Preferably, the initiate pulse is simply transmitted, the initiate pulse being interpreted at the receiver as an instruction to disable the mask signal and commence counting. Following the start pulse, pulse generator 102 outputs a train of pulses up to the number needed to cycle the attenuator counter 50 back to its starting position. The counter pulses are also simply transmitted; however, inasmuch as they follow the "initiate," they increment counter 50. Pulses not following an "initiate" pulse may be transmitted using "find" button 112. These momentarily disable the mask but do not alter counter 50.

If the user desired to adjust the volume as currently set by the attenuator 30 of one or more mask units in an office, the user can depress the "find" button, whereby units within range will respond by momentarily disabling the mask signal during pulses output from pulse generator 122 (i.e., by overdriving the input to amplifier 70). This is audibly perceived as a buzzing noise. The user then chooses a volume and operates the "initiate" switch, whereupon pulses are output in the number of steps required to move to the desired level. Counter 50, however, recycles to zero after its maximum count. Should the number of pulses received exceed the maximum capacity of counter 50, the volume will drop again to the lowest level and so forth. Should the user desire to decrease the volume as controlled by attenuator 30, a number of pulses correspondingly less than the full cycle capacity of counter 50 are output, with the overall effect of lowering the count in counter 50.

Preferably, counter 50 is an eight bit binary counter having a capacity of 256 counts. Of these, only six bits, or a maximum sixty-four counts, are decoded as discrete volume intervals by decoder 30. This is a noise-reduction feature in that the least significant two bits are counted by counter 50 but are ignored when decoding.

It is possible to indicate the desired increase or decrease to pulse counter 118 in hand held unit 100 by other means than a multiple position selector switch 108. For example, switch means capable of indicating either a level, or positive or negative additional steps, are possible. Switch 108 may also be a thumb wheel or a switch pad data entry device capable of entering data on a parallel series of bits.

Depression of "initiate" switch 106 causes transmission of a 1.2 second start pulse, to be followed by a train of count pulses, occurring within 3 seconds. The find pulses sent from pulse generator 122 through RF transmission 120 are otherwise identical to the count pulses used durng an initiate cycle, with the exception that the output amplifier is not muted (all output of the amplifier 72 is muted during an initiate cycle) and is driven with the detected pulses to provice an audibly loud, 100 Hz tone rich in harmonic content and easily identified by the user. The absence of the 1.2 sec preamble pulse prevents one shots 142, 142 from both triggering and thereby prevents the counter from altering the attenuator state.

Pulse generator 122 must operate at a sufficient frequency (e.g., 100 Hz) to complete a full count (e.g., 256) within the allotted time window (e.g, 3 sec). The RF output of transmitter 120 should be at a relatively low frequency, for example between 20 KHz and 300 KHz or so. At these frequencies, the transmitter 120 and receiver 60 become loosely coupled, and the range is short.

A sound level meter 104 is preferably provided in the hand held unit 100. The user of hand held unit 100 can determine by physical movement through the controlled zones whether undue variation in masking volume occurs across zones. The noise level meter will presumably be more senstive than the user and will allow precise adjustments.

Figure 4:
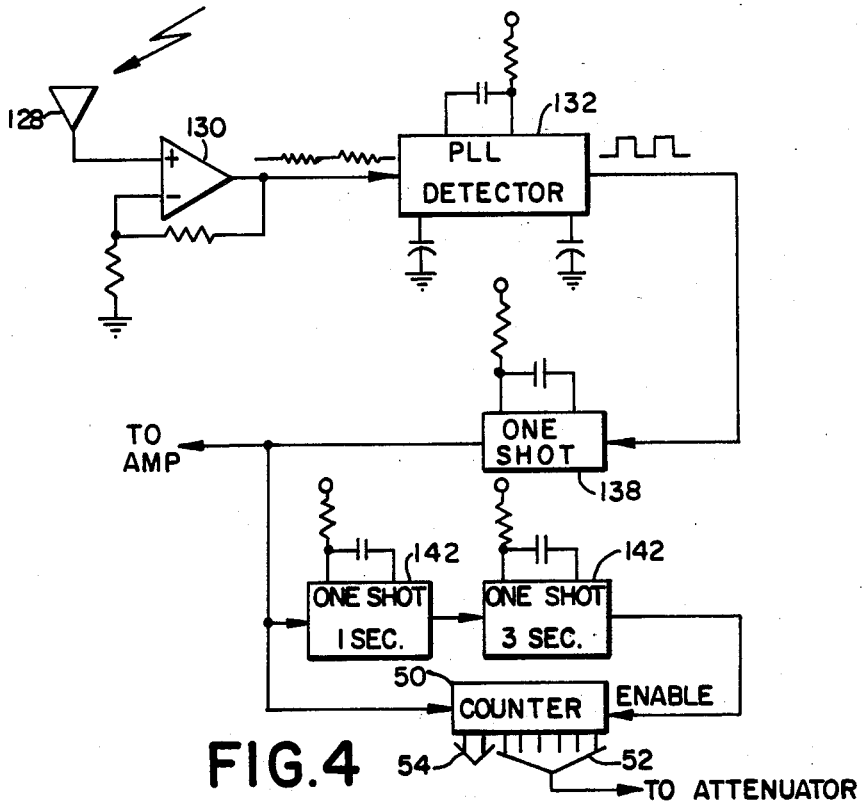
FIG. 4 is a schematic diagram of the radio frequency receiving section of the apparatus.

FIG. 4 is a block diagram illustrating the operation of radio frequency receiver and pulse decoder 60. A signal received on tuned antenna 128 is amplified by broad band amplifier 130. The amplified signal is applied to a phase-locked loop detector 132 in which the output signal is true when a signal is present in the frequency range. That signal is applied to a one shot to eliminate spurious triggering. In any event, the incoming radio frequency pulses or "beeps" are converted into individual digital pulses which are then applied to one shots 142, 144 and to counter 50. One shots 142, 142 are adapted to detect an initiation pulse over one second long and thereafter allow three seconds during which the count in counter 50 may be altered by pulse on one shot 138, once a signal has been found present.

One shots 142 are preferably retriggerable. The one shot 138 is output directly to amplifier 70, to produce the audible buzzing output through speaker 72 during the find function. As noted above the pulses counted by counter 50 are applied to attenuator 30 only through the most significant bits 52. Least significant bits 54 are ignored, providing further safety from spurious operation of counter 50, and therefore change in attenuation level.

Resistors 42, 44, 46, 48 are preferably chosen to accomplish equal dB steps in attenuation level. This is accomplished by dividing "coarse" and "fine" adjustment stages. In this manner, the multiplexer operation corresponds to the weight given the indiviudal bits of counter 50. In order to accomplish such a division, it is preferred that the resistor networks be proportioned for example, such that series resistors 42 are approximately 2K ohms, parallel resistors 44 are 150K and series resistors 46 and parallel resistors 48 are 10K and 11K, respectively. The system allows extremely close volume control over an operating range that approaches a continuous control but is accomplished remotely with a relatively inexpensive arrangement.

Figure 5:
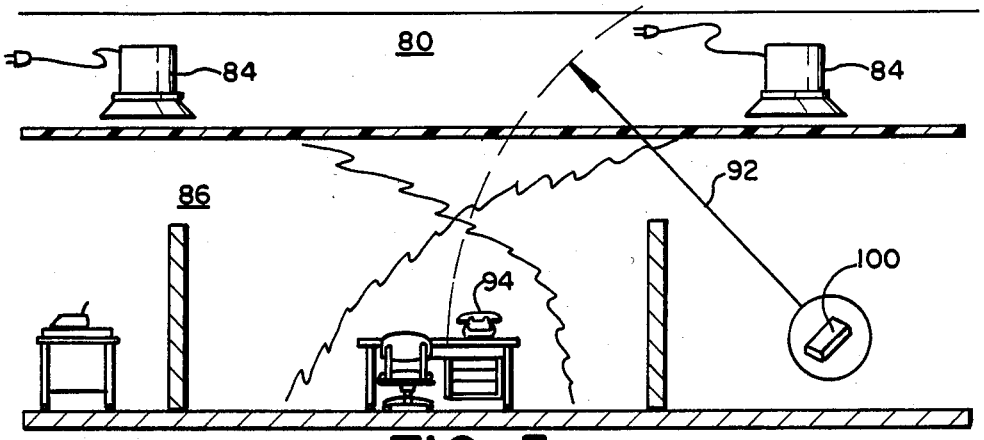
FIG. 5 is an illustration of a physical installation, taken as a section through a building.

FIG. 5 illustrates a physical layout in which sound masking units according to the invention are installed in an office space. The masking signal sources and transducers are prepackaged units 82, 84, which are preferably mounted in the open ceiling space 80 above an office space 86. The user desiring to adjust the operation of the system brings hand held unit 100 into the area to be controlled. Hand held unit 100 transmits at pulse modulated radio frequencies, but at a relatively low frequency and at relatively low power. The average installation will place individual noise sources 82, 84 about 16 feet apart. By operating the transmitter and receiver at frequencies below about 200 KHz (preferably 20–25 KHz), it is possible to achieve an effective range of control of 8–10 feet, which allows control of units 82, 84 within control radius 92, without danger of substantial interaction with units outside the control radius.

In addition to control of attenuator 30, it is possible to achieve equalization over a range of frequencies by providing a suitable shaping network 62, optionally also adjustable under control of RF receiver 60 and hand held controller 100. It will be appreciated that equalization will require a plurality of parallel attenuators, each operable to set the volume at a discrete frequency range. An alternative device for equalization control can include a controller for individual sound sources and a complex mobile test device having remote control capability to adjust attenuation over the range of audible frequencies. Inasmuch as one such controller can test and control all zones, sophisticated test frequency sour es and the like may be cost-justified. The cost savings justify various conveniences such as testing features, automatic stepping through frequency ranges, and the like . A plug-connectable controller 140 for equalizer 62 can be used, as shown in FIG. 1. The plug connection can be located on or in the area of the housing of ceiling-mounted units 82, as it will be only used occasionally.

Figure 6:
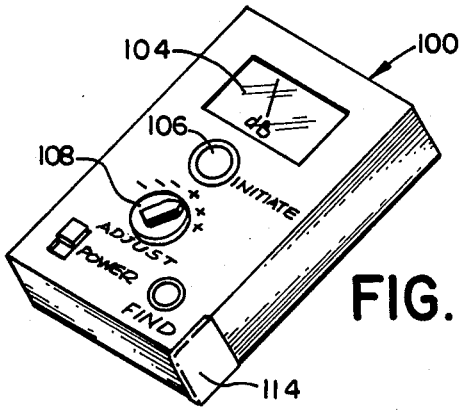
FIG. 6 is a perspective view of a hand-held controller.
Figure 7:
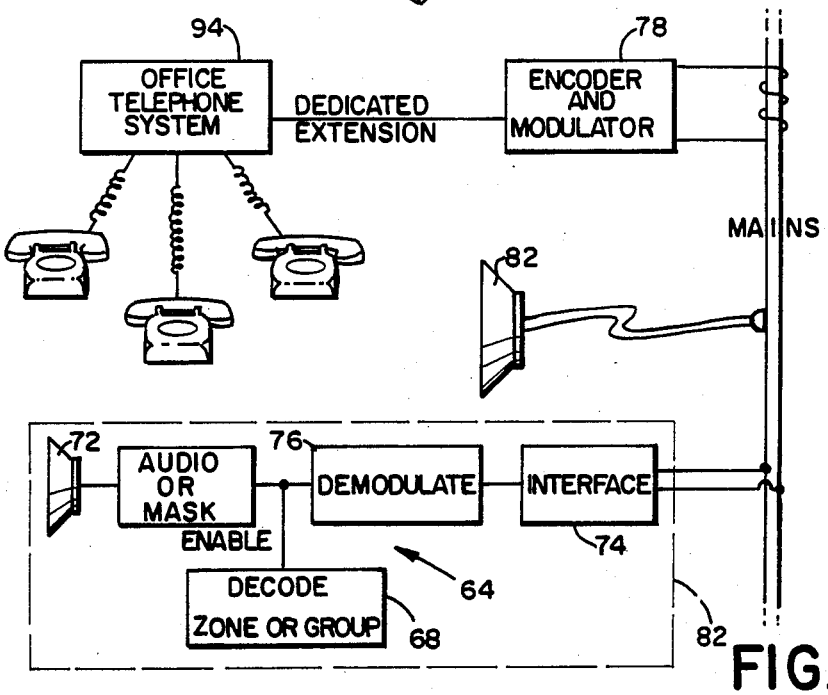
FIG. 7 is a schematic block diagram showing an interface for momentarily suppressing the mask signal and inserting paging.

The system preferably incorporates a paging device adapted to temporarily replace the background masking sound. A paging device 64 that optionally includes address decoding is illustrated in FIG. 6. Inasmuch as all the individual masking noise emitters 82, 84, etc. are powered through the same AC mains, it is possible to superimpose voice paging signals on the power lines, and to detect and amplify the paging signals at the individual units. Office telephone system 94 is provided with a dedicated extension, the output of which is used to apply a radio frequency signal to the domestic mains. Encoder and modulator 78 may include addressing circuitry to identify particular zone units or groups of zone unit that will decode address signals and respond to the page. Interface unit 74 (essentially a high pass filter) and demodulator 76 convert the radio frequency signal into address pulses and an audio signal. The pulses represent address bits peculiar to one or more individual units that detect their address in the pulses transmitted along the mains and enbable amplification of the audio signal through amplifier 70. During paging, the units disable the masking noise transmitted from noise source 20. It will be appreciated that these paging signals are extremely effective and noticeable. When a paging signal is transmitted, the background masking momentarily noise drops away leaving an unusual a quiet against which a paging signal is a sharp contrast.

In order to distinguish between the paging signal and the control signals produced by controller 100, it is presently preferred that the paging signal be a frequency modulated signal, also at about 200 KHz. The frequency modulated signal is detected using a phase-locked loop demodulator. By placing the addressing data on the line immediately preceeding the audio signal, and by transmitting start and stop codes such as a long "start" pulse and an "end" signal when the dedicated extension is disconnected by the office telephone system 94, the masking signal is again enabled following the page.

According to the invention, very precise volume control is provided by means of the discrete level attenuation system disclosed. Furthermore, such an attenuator is very well suited for use with automatic or remote control, and the remote control provides substantial cost savings and benefits in convenience and versatility. Upon installation, the user can progressively increase the masking volume over a period of time in intervals of a very small portion of the full control range, such that persons in the affected area do not notice the change and are not distracted by the masking noise. Such person is likely to perceive the office as quieter rather than noisier in this manner. Furthermore, individual zone needs can be precise accomodated by convenient custom adjustment of the masking noise source for each separate zone. All this may be done without ever opening the ceiling above the office to access individual units 82, 84, which are entirely controllable from a distance.

The invention having been disclosed, a number of additional variations will now become apparent to persons skilled in the art. Reference should be made to the appended claims rather than the foregoing specification as indicating the true scope of the invention.

What is claimed is:

1. A sound masking apparatus, comprising: one or more sound masking units, each unit including:

a signal source operable to supply an incoherent electrical signal over a range of audible frequency;

a power amplifier and audio transducer adapted to produce an audible sound radiating into a free space defined by at least one of floors, walls and ceilings of a structure, the audible sound being produced in response to an electrical signal at an input to said power amplifier;

a programmable attenuator connected between the signal source and the power amplifier, the attenuator having means to adjust amplitude of the electrical signal at the input to the power amplifier, the one or more sound masking units being mountable in the structure and the audible sound radiating from the one or more sound masking units defining one or more masking zones; and, a remote controller operable to control operation of the attenuator of one said sound masking unit at a time from a distance, individually, the remote controller being mobile and including means to transmit a short-range radio signal across open air ways to the programmable attenuator, the radio signal adapted to indicate a desired power level and the programmable attenuator including means for receiving and decoding said signal, the programmable attenuator maintaining the desired level after cessation of the radio signal.

2. The sound masking apparatus of claim 1, wherein the remote control has a range of 8–10 feet.

3. The sound masking apparatus of claim 1, wherein the radio signal is pulsed at a pulse frequency of 100 Hz on a carrier frequency of about 20 KHz to about 300 KHz.

4. The sound masking apparatus of claim 3, wherein the carrier frequency is about 20–25 KHz.

5. The sound masking apparatus of claim 3, wherein the radio signal is a pulse train representing a desired change in present signal level of the attenuator.

6. The sound masking apparatus of claim 1, wherein the attenuator is stepwise adjustable by means of said remote controller to any of a plurality of discrete volume steps.

7. The sound masking apparatus of claim 1, wherein the signal source, attenuator, power amplifier and transducer are permanently mountable in a structure partly enclosing a sound masking zone and the remote controller is a mobile unit movable through the zone.

8. The sound masking apparatus of claim 7, further comprising a plurality of sound masking units, each having an individual attenuator, signal source, power amplifier and transducer, each individual attenuator responsive to the remote controller.

9. The sound masking apparatus of claim 1, wherein the remote controller is operable to select one of a plurality of discrete signal levels, the programmable attenuator having voltage dividers connected to the signal source and gating means for selecting one of a plurality of discrete levels presented by the voltage divider.

10. The sound masking apparatus of claim 9, wherein the remote controller is operative to transmit a pulse train and the attenuator includes a pulse counter and an analog multiplexer for selecting one of a plurality of said voltage levels.

11. The sound masking apparatus of claim 10, wherein the attenuator includes a multiple stage analog multiplexer, each of the stages having an address-selectable connection between one first signal line and a plurality of second signal lines, the second signal lines being connected to one another and to a common ground through resistors and the stages being serially connected to one another, whereby address-select inputs to the respective steps are operative to select one of a plurality of possible attenuations.

12. The sound masking apparatus of claim 11, wherein the attenuator has a two stage analog multiplexer, each stage having three line-select address inputs and eight selectable lines, the stages being connected in mirror image such that the eight selectable lines of a first stage feed to the eight selectable lines of a second stage.

13. The sound masking apparatus of claim 1, further comprising a source for paging signals and means for gating the paging signal in place of the masking signal, whereby paging signals are emphasized by concurrent reduction of background noise.

14. The sound masking apparatus of claim 8, wherein the individual attenuators, signal sources, power amplifiers and transducers are mounted in plastic receptacles, the receptacles having means for connection to AC power and means for mounting within a ceiling.

15. A sound masking apparatus, comprising:

a plurality of sound masking units;

a signal source operable to supply an incoherent electrical signal over a range of audible frequencies, a power amplifier and audio transducer adapted to produce an audible sound in response to an electrical signal at an input to said power amplifier, a programmable attenuator connected between the signal source and the power amplifier, the attenuator having means to adjust amplitude of the electrical signal at the input to the power amplifier;

a remote controller operable to control operation of the attenuator from a distance, the remote controller including means to transmit a radio signal indicating a desired power level and the programmable attenuator including means for decoding said signal, the programmable attenuator maintaining the desired level after cessation of the radio signal, the signal source, attenuator, power amplifier and transducer being permanently mountable and the remote controller being mobile; and, a sound meter mounted within the remote controller, the sound meter being operable to detect differences in level between zones served by said individual attenuators, signal sources, power amplifiers and transducers.

16. The sound masking apparatus of claim 15, further comprising sound equalization means connected to at least one of the signal source and the attenuator, the equalization means being operable to set signal amplitude as a function of frequency over a predetermined frequency range.

17. The sound masking apparatus of claim 16, wherein said equalization means is controllable by the mobile remote controller.

18. A sound masking system comprising: a plurality of sound masking units, each having:

a signal source operable to supply an incoherent electrical signal over a range of audible frequencies, a power amplifier and audio transducer adapted to produce an audible sound in response to an electrical signal at an input to said power amplifier, a progammable attenuator connected between the signal source and the power amplifier, the attenuator having means to adjust amplitude of the electrical signal at the input to the power amplifier, the sound masking units being permanently mountable in a structure, at spaced points defining sound masking zones;

a remote controller operable to control operation of the attenuators of each of said sound masking units from a limited distance, the remote controller including means to transmit a radio signal indicating a desired power level and each of the programmable attenuator including means for decoding said signal, the programmable attenuators maintaining the desired level after cessation of the radio signal, the remote controller having a range of 8–10 feet, whereby the controller sets audible sound levels in said zones while passing though the zones.

19. A sound masking apparatus, comprising:

a remotely-controllable sound masking unit having a signal source producing an incoherent electrical signal, a power amplifier and audio transducer adapted to produce an audible sound in response to an electrical signal at an input thereof and a programmable attenuator responsive to a remote controller, the programmable attenuator connected between the signal source and the power amplifier, the attenuator having remotely-controllable means for adjusting amplitude of the electrical signal at the input to the power amplifier, including means for decoding a signal received from the remote controller, the programmable attenuator maintaining the desired level after cessation of the radio signal, the programmable attenuator including a two stage multiplexer having a first stage with one input selectably connectable to any of a plurality of addressable outputs, and a second stage having a plurality of addressable inputs connectable to one output, the addressable outputs of the first stage being connected between a signal line and ground by a resistor network, and the programmable inputs of the second stage being connected between said signal line and ground by a further resistor network, the programmable attenuator including addressing means having bits selecting outputs of the first stage and inputs of the second stage to set a predetermined attenuation by selection of an address to said stages.

20. The sound masking apparatus of claim 19, wherein the addressing means of the programmable attenuator includes a digital counter for counting pulses from the remote controller, outputs of the counter addressing the first and second stages of the multiplexer.

21. The sound masking apparatus of claim 20, wherein the counter is a binary counter and the output of the counter addressing the first and second stages of the multiplexer are connected to select discrete attenuation steps in decibel (dB) intervals.

22. A sound masking apparatus, comprising:

at least one sound masking apparatus including a signal source operable to supply an incoherent electrical signal over a range of audible frequencies, a power amplifier and audio transducer adapted to produce an audible sound in response to an electrical signal at an input to said power amplifier, the audible sound being emitted into a free space adjacent the sound masking unit in response to an electrical signal at an input to said power amplifier, the unit being mountable in a structure and the audible sound being emitted into a free space in the structure defined by at least one of floors, walls and ceilings of the structure, the sound masking unit having a programmable attenuator connected between the signal source and the power amplifier, the attenuator having means to adjust amplitude of the electrical signal and the input to the power amplifier; and a remote control operable to control operation of the attenuator from a limited distance within a dimension of the sound masking zone, whereby the remote controller is operable to individually control said attenuator, the remote controller being mobile and including means to transmit a short-range radio signal across open airways to the programmable attenuator, the radio signal adapted to indicate a desired power level and the programmable attenuator including means for receiving and decoding said signal, the programmable attenuator maintaining the desired level after cessation of the radio signal.

* * * * *